US010183788B2

(12) United States Patent
Janis et al.

(10) Patent No.: US 10,183,788 B2
(45) Date of Patent: Jan. 22, 2019

(54) SPILL RESISTANT INTEGRATED CLOSURE CAP

(71) Applicants: Leonard Janis, Columbus, OH (US); Bruce Thornbloom, Powell, OH (US)

(72) Inventors: Leonard Janis, Columbus, OH (US); Bruce Thornbloom, Powell, OH (US)

( * ) Notice: Subject to any disclaimer, the term of this patent is extended or adjusted under 35 U.S.C. 154(b) by 553 days.

(21) Appl. No.: 14/921,224

(22) Filed: Oct. 23, 2015

(65) Prior Publication Data

US 2017/0113850 A1 Apr. 27, 2017

(51) Int. Cl.

| | |
|---|---|
| ***B65D 47/36*** | (2006.01) |
| ***A63H 33/28*** | (2006.01) |
| ***B65D 47/08*** | (2006.01) |
| ***B65D 47/20*** | (2006.01) |
| ***B65D 47/24*** | (2006.01) |

(52) U.S. Cl.

CPC ..... *B65D 47/0842* (2013.01); *A63H 33/28* (2013.01); *B65D 47/2062* (2013.01); *B65D 47/245* (2013.01)

(58) Field of Classification Search

CPC ..... B65D 2251/1058; B65D 47/0833; B65D 47/0838; B65D 47/0804; B65D 47/0808; B65D 47/083; B65D 51/1644; B65D 51/1633; B65D 51/16; B65D 43/161; B65D 47/36

USPC ..... 215/243, 237, 234

See application file for complete search history.

(56) References Cited

U.S. PATENT DOCUMENTS

| | | | | |
|---|---|---|---|---|
| 1,050,265 | A * | 1/1913 | Crone | A45D 40/221 220/259.2 |
| 5,246,046 | A | 9/1993 | Schramm | |
| 6,135,842 | A * | 10/2000 | LaFata | A63H 33/28 206/207 |
| 6,406,347 | B2 * | 6/2002 | Swagel | A63H 33/28 215/391 |
| 6,520,822 | B2 | 2/2003 | Kennedy | |
| 7,524,230 | B2 | 4/2009 | Thai | |
| 8,430,708 | B1 | 4/2013 | Schramm | |
| 2002/0070218 | A1 * | 6/2002 | Mozes | B65D 43/161 220/254.3 |
| 2002/0104855 | A1 * | 8/2002 | DeGroot | B65D 47/0804 222/556 |

* cited by examiner

*Primary Examiner* — Anthony Stashick
*Assistant Examiner* — Raven Collins
(74) *Attorney, Agent, or Firm* — Harpman + Harpman

(57) ABSTRACT

A lift top cap for bottles and the like adapted to be used on liquid filled bottle allowing selective directional access through cap base portion having a limited access opening with internal one way sealing. The flip top cap has a raised central portion registerable with the enabled access opening. A flexible insert slot defines the access cap base opening with a spring urged one way valve mounted there with for sealing registration with access opening when not accessed.

7 Claims, 7 Drawing Sheets

SPILL RESISTANT INTEGRATED CLOSURE CAP

BACKGROUND OF THE INVENTION

1. Technical Field

This invention relates generally to closure caps such as flip top cap configurations having a base portion engageable on a bottle and an attached closure cap registerable there over and specifically spill resistant caps and bottles to prevent spillage from container filled with liquid such as bubble solution.

2. Description of Prior Art

Prior art devices of this type have been directed to basic spill resistant container structures having a single liquid resistant access on the bottle, see for example U.S. Pat. Nos. 5,246,046, 6,135,842, 6,520,822, 7,524,230 and 8,430,708.

U.S. Pat. No. 5,246,046 discloses a spill resistant solution container having an external bottle neck insert.

U.S. Pat. No. 6,135,842 claims a spill resistant bubble blowing apparatus with cap insert defining an access slot with flexible material to seal after and before the bubble wand is inserted.

U.S. Pat. No. 6,520,822 is directed to a bubble toy container with a spill resistant bubble wand having a bubble ring with solution supply channels and articulated joint between multiple rings formed within.

U.S. Pat. No. 7,524,230 illustrates a non-spill container having a stopper on the bubble wand registerable on an extended container access tube offset from the primary chamber.

Finally, U.S. Pat. No. 8,430,708 shows a large spill proof bubble creation applicator having separable solution bottle with main container.

SUMMARY OF THE INVENTION

A flip top spill resistant cap for liquid container allowing intermittent dispenser wand insertion through an access opening with primary and secondary liquid retainment fixtures. The primary one-way valving trap door combines with the flexible access slot providing bubble dispensing wand insertion and removal while preventing solution spilling. An access slot exterior stopper extends from the flip cap corresponding thereto within closed non-wand use position.

DETAILED DESCRIPTION OF THE INVENTION

Figure 1:
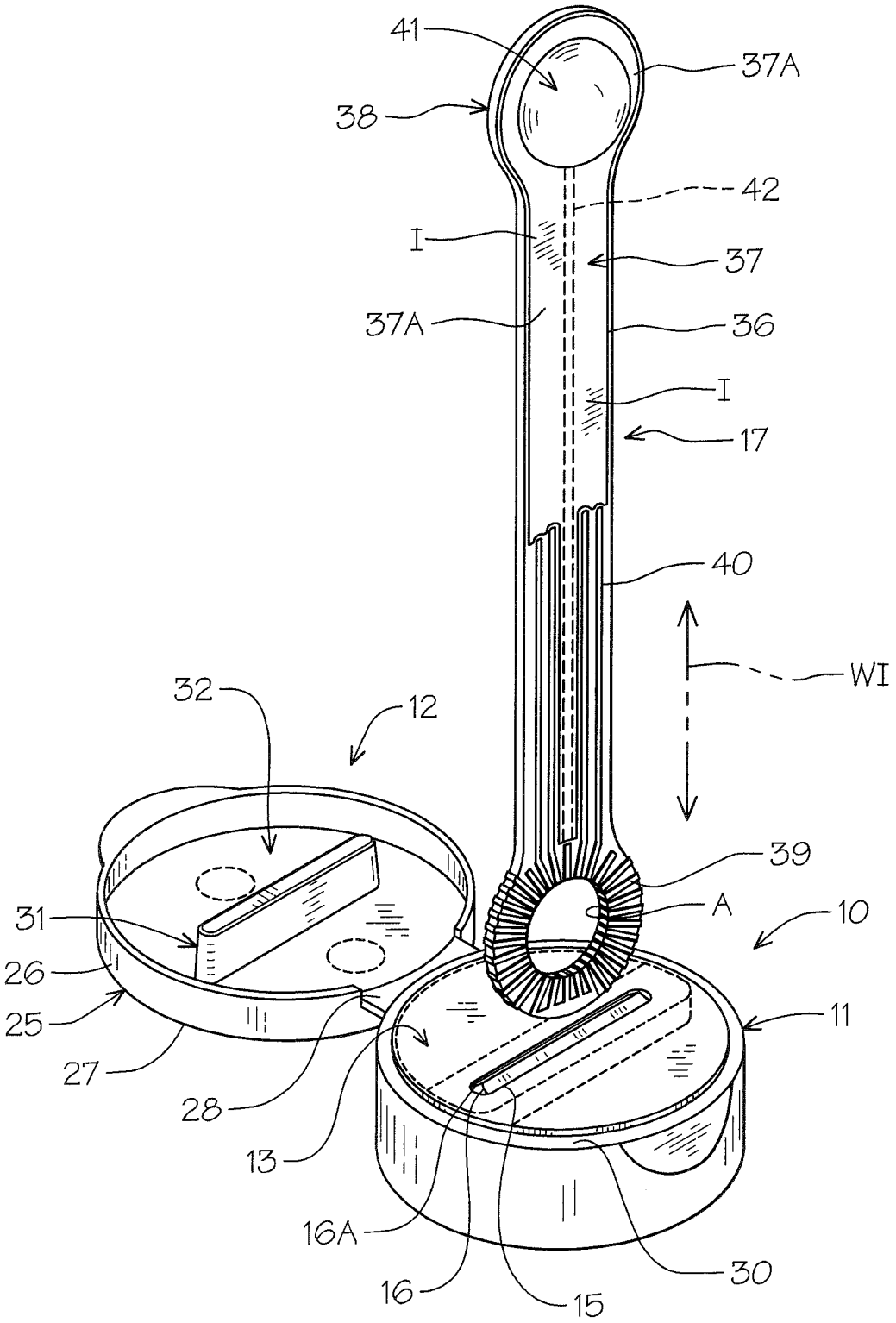
FIG. 1 is a top, front and side perspective view of the flip top cap closure in open access position with a dispensing bubble wand position for insertion therein.
Figure 2:
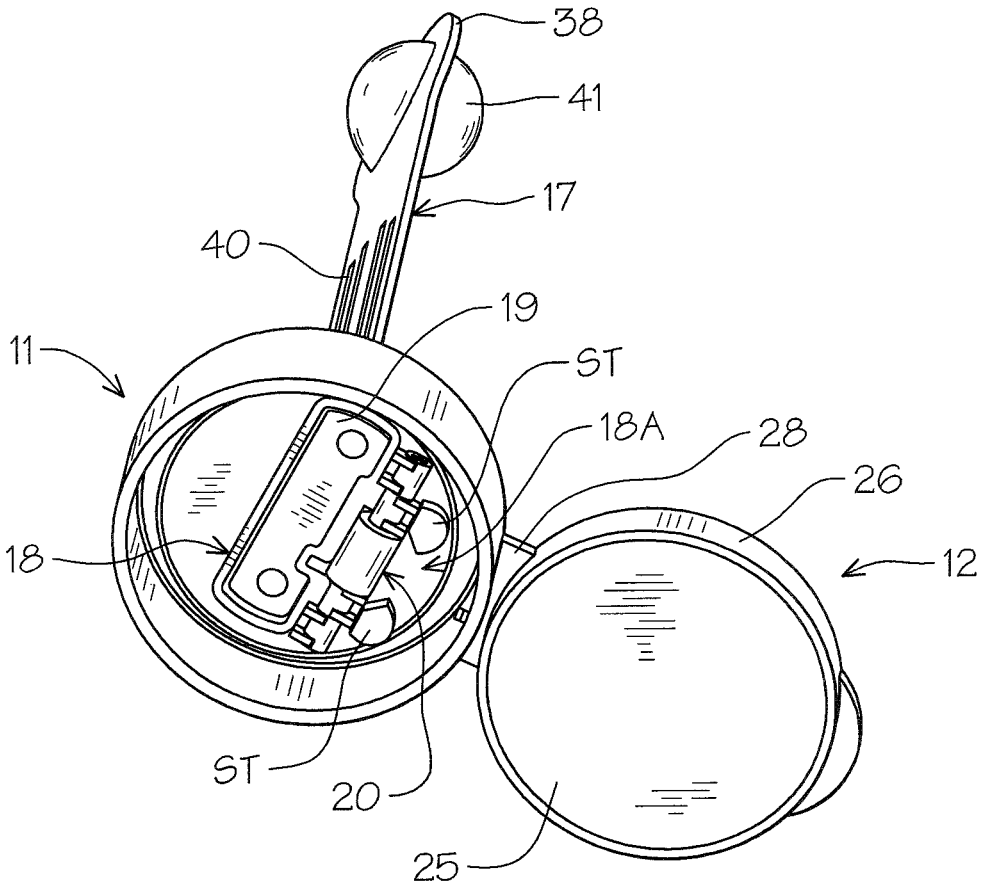
FIG. 2 is a bottom perspective view of the flip top cap closure of the invention as seen in FIG. 1 of the drawings.
Figure 3:
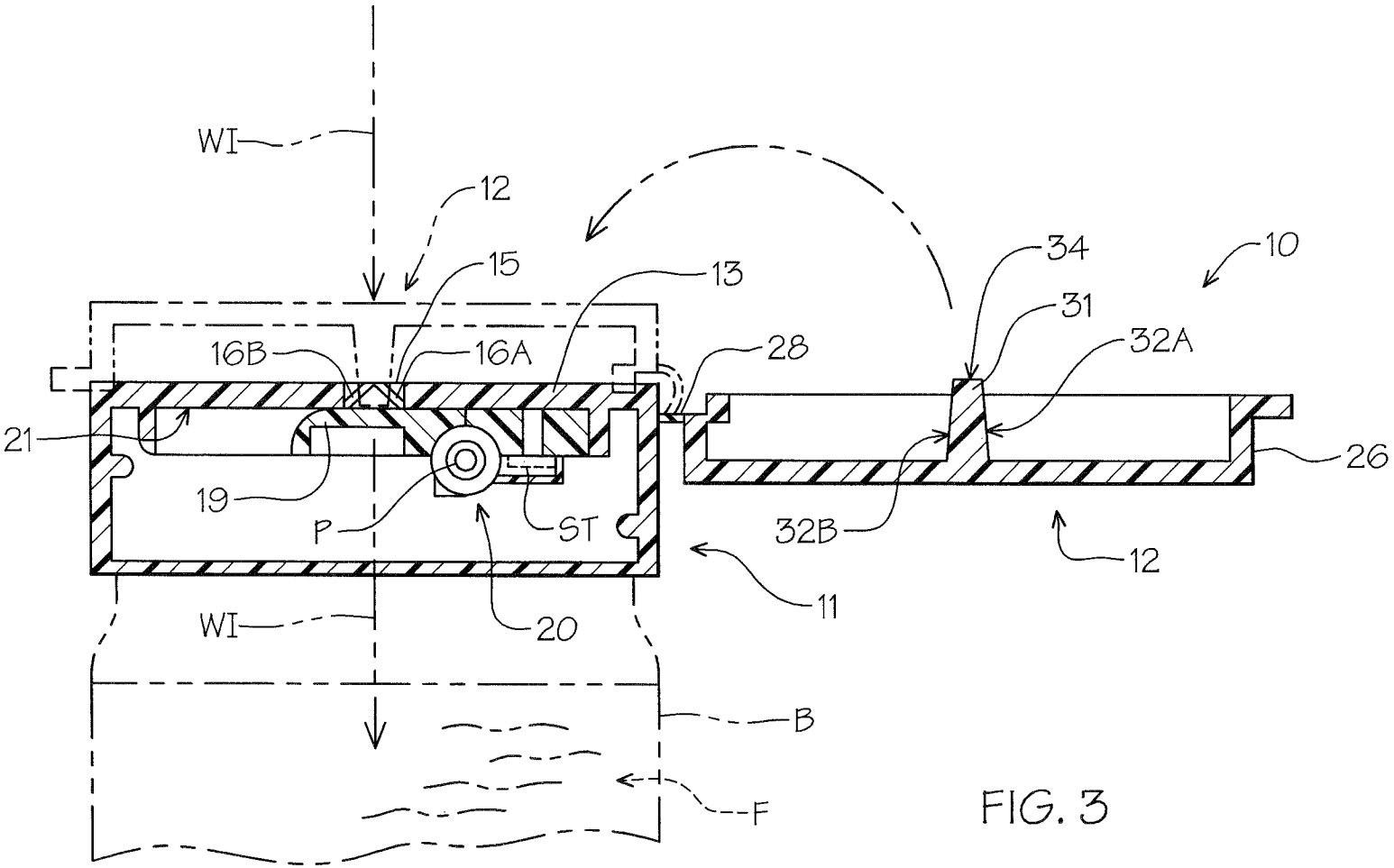
FIG. 3 is a partial enlarged cross-sectional view on lines 3-3 of FIG. 1.
Figure 4:
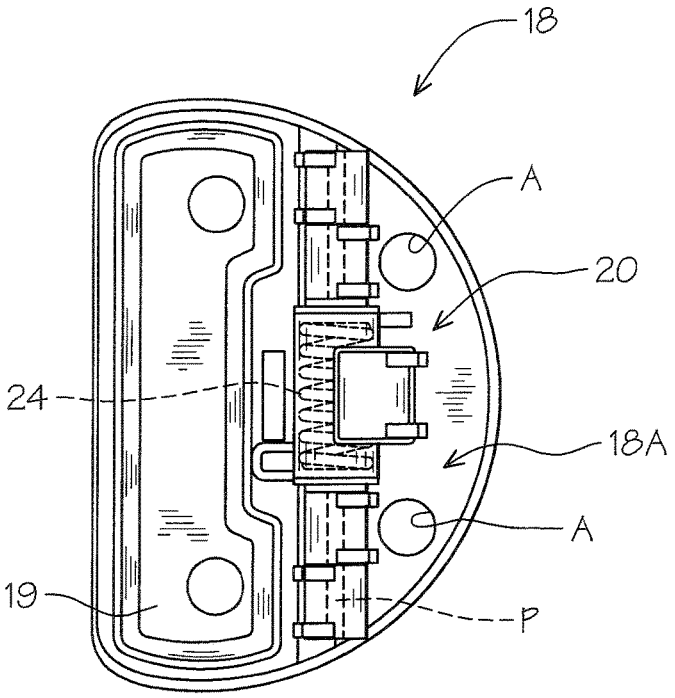
FIG. 4 is an enlarged bottom plan view of a spring actuated trap door fitting prior to mounting within the flip top cap configuration.
Figure 5:
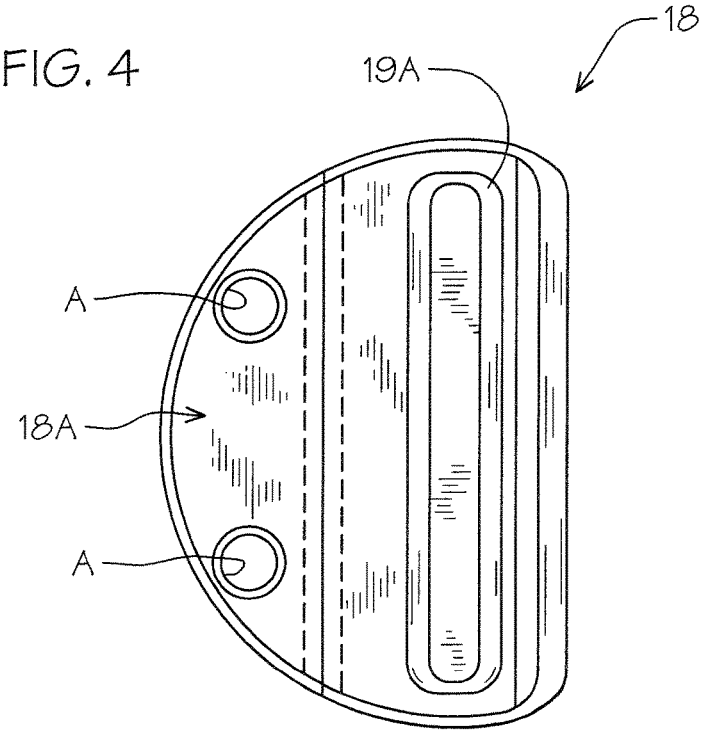
FIG. 5 is an enlarged top plan view thereof.
Figure 6:
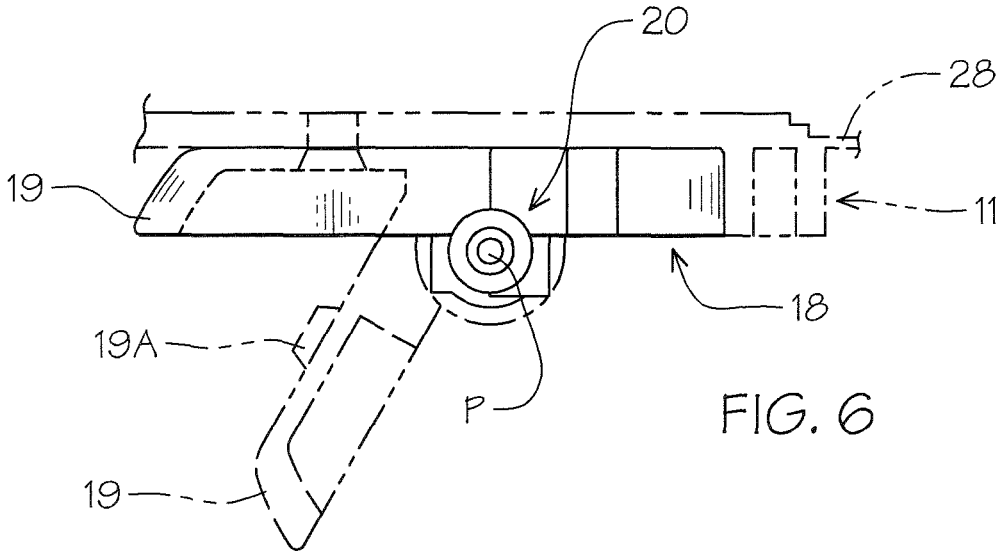
FIG. 6 is an enlarged side elevational view thereof with portions shown in broken lines.
Figure 7:
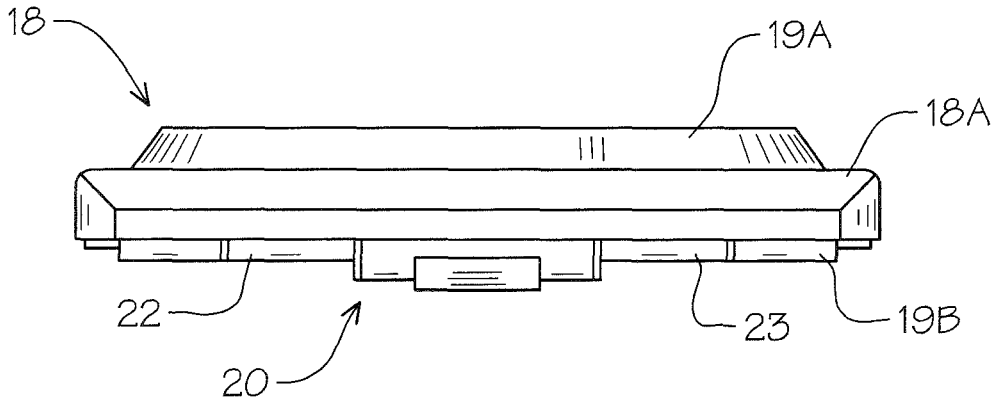
FIG. 7 is an enlarged front elevational view of the spring trap door fitting.

Referring to FIGS. 1, 2 and 3 of the drawings, a flip top cap assembly 10 of the invention can be seen for use as a selective closure on a solution supplied bottle B shown partially in broken lines.

The flip top cap assembly 10 has an annular cap base portion and flap top cap portion 12. The cap base portion 11 has generally flat upper surface 13 with an annular depending vertical perimeter wall 14 thereabout. A rectangular access slot at 15 is positioned centrally therein. The rectangular access slot 15 has parallel flexible closure surfaces 16A and 16B which will allow a bubble dispensing wand 17 access under directional insertion as will be described hereinafter and affords a primary seal through which solution will not readily pass as is well known within the art.

A base cap trap door insert 18 is positioned within the base cap portion 11 secured directly to the oppositely disposed lower surface thereof as best seen in FIG. 2 of the drawings. The trap door insert 18 is semi-circular in shape with a dual apertured cap engagement mounting portion 18A and a hinged door 19 pivotally attached thereto. The hinged door 19 is spring urged by a spring hinged assembly 20 mounted on the outer cap engagement portion 18A. The hinged trap door 19 is adapted therefore to overlie the hereinbefore described access slot 15 providing a primary liquid resistant seal there between as best seen in FIG. 3 of the drawings. The hinge door 19 has an upstanding elongated valve element 19A on its cap engagement surface and is of a dimension so as to be registerable partially within the access slot 15 which defines a valve seat 15A there within.

The spring hinge assembly 20, best seen now in FIGS. 3, 4, 5 and 6 of the drawings is fitted into a correspondingly contoured recess 21 in the cap engagement portion 18A adjacent the dual longitudinally spaced apertures A for heat staking ST thereto as is well known and understood within the art.

The spring hinge door assembly 20 has a pair of longitudinally aligned spaced hinge fittings 22 and 23 on a pivot pin P interconnecting the trap door 19 and the correspondingly fixed insert cap engagement portion 18A.

A coil spring 24 is positioned there between engageable on the respective trap door 19 at 24A and cap engagement portion 18A at 24B providing spring urged engagement tension there between to maintain the trap door 19 against the access slot 15 as hereinbefore described and seen in FIGS. 2 and 3 of the drawings.

Referring now to the flip top cap portion 12 as seen in FIGS. 1, 2 and 3 of the drawings, it can be seen as having a circular top 25 with a depending annular flange 26 extending vertically from a perimeter defined edge 27 thereof.

A living hinge 28 extends integrally from a free end edge 29 thereof to the upper perimeter edge of the upper surface 12 as hereinbefore described base portion 11, best seen in FIG. 3 of the drawings. The living hinge 28 provides the flip top cap portion 12 support and alignment for registerable engagement over the cap base portion 11 which has an annular perimeter recess 30 thereabout for corresponding aligned engagement. An elongated rectangular raised central lug 31 extends from the underside 32 of the top 25 in spaced parallel relation to the living hinge 28 and hereinbefore described access slot 14 therein. The raised central lug 31 has oppositely disposed tapered sidewalls 32A and 32B defining a dimensionally reduced top surface 34 adapted for aligned registration with and within the access slot 15 when in closed position as shown in broken lines in FIG. 3 of the drawings.

Figure 8:
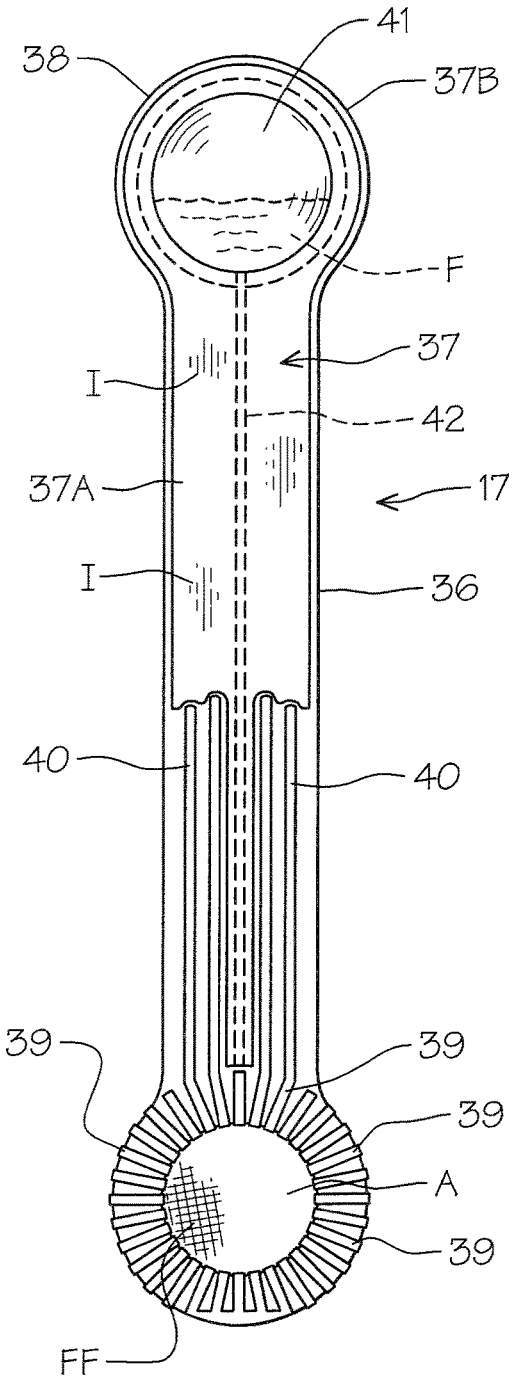
FIG. 8 is a front elevational view of a dispenser wand.
Figure 9:
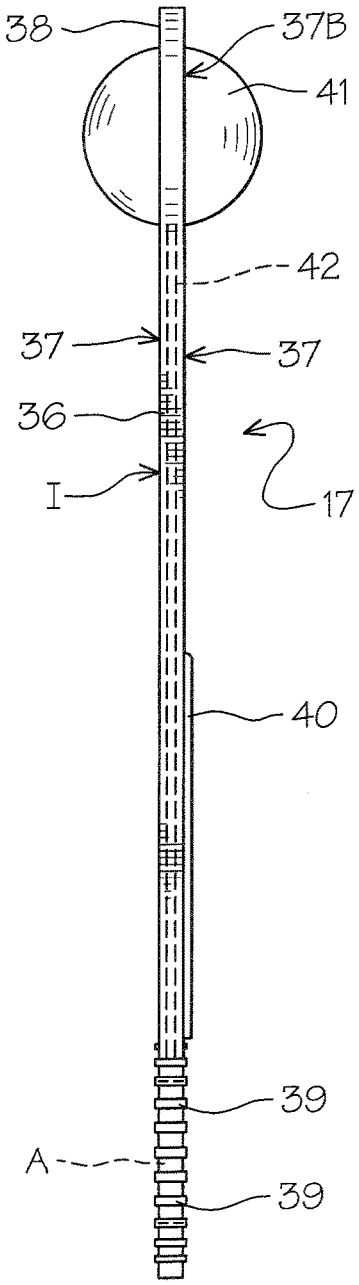
FIG. 9 is a side elevational view thereof.

In this example, a liquid transfer wand 17 can be seen in FIGS. 1, 8 and 9 of the drawings for selective insertion and removal through the cap assembly 10. The wand 17 has an elongated body member 36 defining a wide, flat handle portion 37 with an aperture A annular end 38 of the wand 17 for fluid F transfer via a surface tension film formation FF there within as is required for functional formation of bubbles when airflow is applied as is understood in the bubble formation as is well known within the art.

A plurality of individual radially spaced extending ribs 39 are formed about the aperture A on oppositely disposed surfaces of the annular end 38. The body member 36 has multiple elongated spaced parallel ribs 40 extending partially there along from the handle portion to and intersecting with some of the ribs 39 to channel fluid F there along to the aperture A to aid in the formation of the film FF there within as described. The handle portion 37 has a flat displaced surface 37A for informational marking indicia I thereon with an enlarged aperture annular end 37B, best seen in FIGS. 8 and 9 of the drawings. The annular end 37B has a resilient hollow bulb 41 secured therein with its interior in communication with a fluid transfer tube 42 formed within the handle portion 37 and extending to the apertured annular end 38.

It will be seen that the overall diameter and material thickness of the apertured annular end 38 for bubble formation is less than that of the hereinbefore described access slot 15 so as to provide for ease of insertion and retrieval there through as described below.

In operation, access through the flip top cap assembly 10 is achieved in the following sequence. The flip top cap portion 12 must be engaged and removed from the cap base portion 11 to allow for insertion and subsequent removal of the transfer wand 17 through the cap access slot 15 as seen in FIG. 1 of the drawings. Upon wand 17 insertion indicated by directional arrows WI, the annular apertured end 38 of the wand 17 engages and parts the respective hereinbefore described parallel flexible sealing flaps 16A and 16B then engaging the hinged door 19 valve element overcoming the resistant pressure imparted by the door spring. The wand 17 can then access the bottle B collecting liquid both as a film over the ribbed parameter aperture and by depressing and slowly releasing the bulb 41 creating a suction to draw up and in, bubble fluid F retaining same and then be removed with drawing back through the access slot 15 allowing the door 19 to close restricting the contents of the bottle B from spilling under non-vertical orientation which may occur during use. The retained bubble fluid F can then be selectively dispensed by compression of the bulb 41 by the user, not shown, transfer bubble fluid from the bulb 41 through the transfer tube 42 to the film formed aperture A for continued use.

Figure 10:
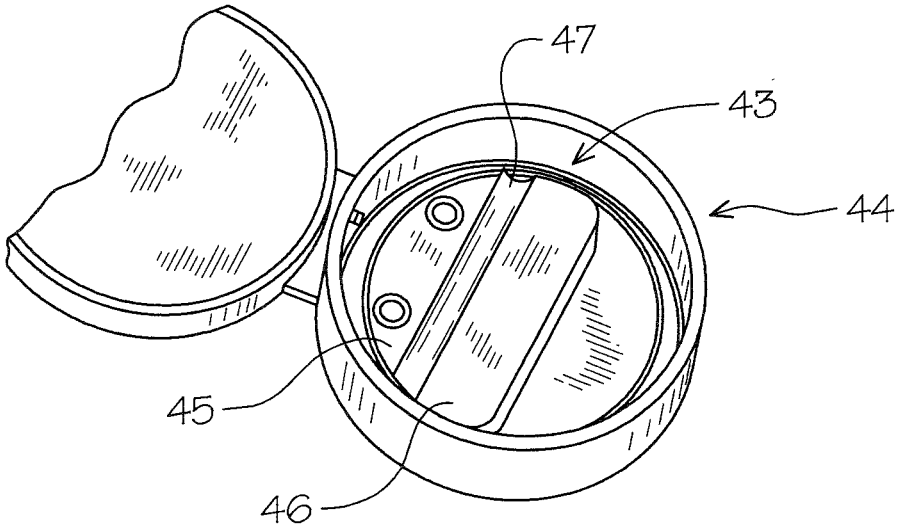
FIG. 10 is a bottom perspective view of an alternate resilient trap door valve seal within the flip top cap with portions broken away for illustration.
Figure 11:
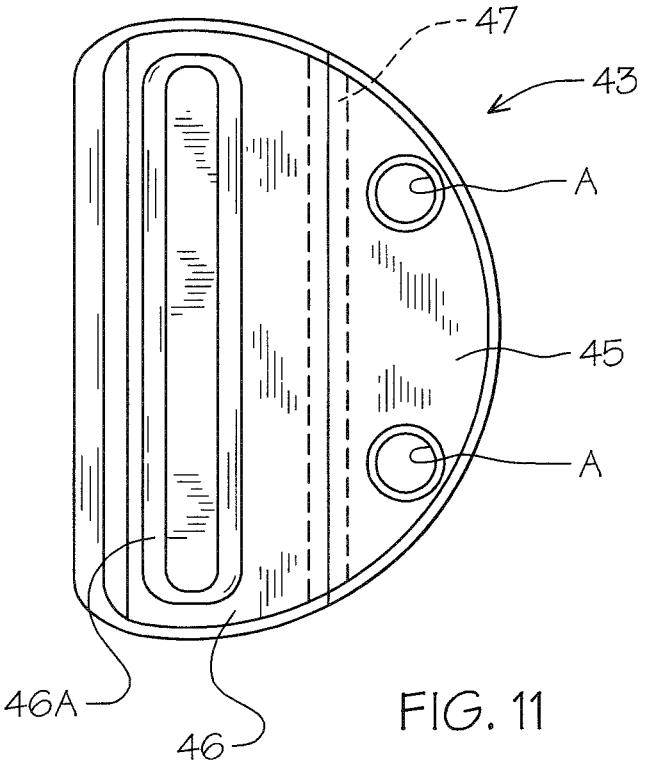
FIG. 11 is a top plan view of the alternate trap door valve seal.
Figure 12:
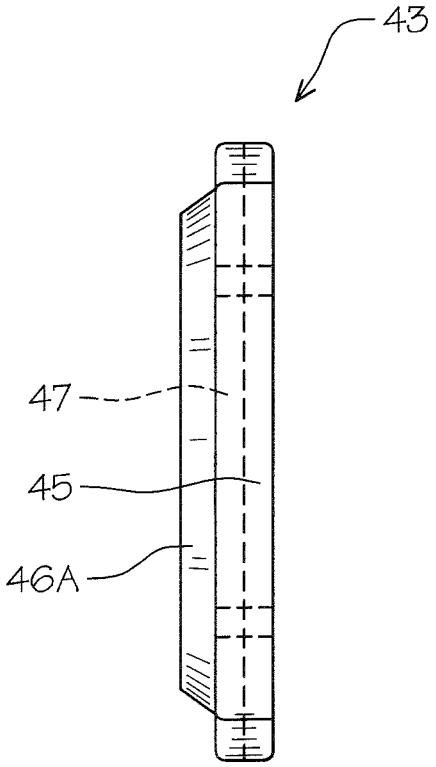
FIG. 12 is a side elevational view thereof.

Referring now to FIGS. 10-12 of the drawings, an alternate trap door insert 43 can be seen positioned in a corresponding base cap portion 44. The alternate trap door insert 43 is of a circular configuration of similar dimension to that of the primary trap door 18 having a dual apertured cap attachment portion 45 and an integrated live hinged door 46 with an upstanding valve element 46A. An elongated living hinge 47 is formed there between allowing the door 46 deflection shown in broken lines in FIG. 11 of the drawings under engaged insertion of the wand 17 through the hereinbefore described access slot 15.

It will thus be seen that an integrated adaptable spill resistant access cap configuration has been illustrated and described and that various changes and modifications may be made thereto without departing from the spirit of the invention, therefore we claim:

1. A spill resistant cap for liquid dispensing containers enabling insertion and removable of a fluid transfer retainment and select dispensing wand, said cap comprises, a base access cap and a flip top cap closure, each having respective perimeter depending sidewalls, said base access cap having an upper surface, an elongated access opening formed therein, continuous parallel flexible abutting flanges in the length of said opening, said flip top cap comprises, a top, an elongated opening closure lug extending from said top in spaced relation to said depending sidewall, said base access cap upper surface is circular and said depending sidewall is annular a living hinge extending integrally from said top's depending sidewall to said base access cap, adaptable to align said closure lug in registration with said abutting flanges in said access opening, a resiliently urged valve insert comprising, a base access cap engagement mounting portion and a hinged door having an upstanding valve element surface movable from a first closed base access cap engagement position to a second open position, said upstanding valve element surface aligned for registration over said access opening in said base access cap, said base access cap engagement mounting portion having a dual apertured semicircle cap attachment portion.

2. The spill resistant cap for liquid dispensing containers set forth in claim 1 wherein said flip top cap top and depending sidewall are annular, and wherein said flip top cap annular sidewall outer periphery edge are of a registration dimension with the periphery of said upper surface of said base access cap.

3. The spill resistant cap for liquid dispensing containers set forth in claim 1 wherein said resiliently urged valve insert further comprises, a spring fitting pivotally secured to said base access cap with said base access cap mounting portion in communication with said hinged valving element.

4. The spill resistant cap for liquid dispensing containers set forth in claim 1 wherein said resiliently urged valve insert further comprises, a hinged door insert having a one-piece cap attachment portion, a living hinge in communication with said cap attachment portion and said hinged door.

5. The spill resistant cap for liquid dispensing containers set forth in claim 1 wherein said, fluid transfer retainment and select dispensing wand, comprises, an elongated handle portion, a resilient fluid retainment and transfer bulb in an enlarged adapted wand end, an apertured annular liquid film retention and dispensing end portions, transfer tube in said handle portion in communication with said retainment and transfer bulb and said annular liquid film retention and dispensing end portion, and a plurality of radially spaced ribs positioned thereabout.

6. The spill resistant cap for liquid dispensing containers set forth in claim 5 wherein said handle portion comprises, a transversely wide flat display engagement surface, a plurality of spaced parallel elongated surface fluid transfer ribs in communication with said radially spaced ribs on said liquid film retention and dispensing end portion.

7. The spill resistant cap for liquid dispensing containers set forth in claim 5 wherein said apertured annular liquid film retention and dispensing end portion is of a known dimension less than that of said base access cap upper surface opening.

* * * * *